US006176006B1

(12) United States Patent
Milliman et al.

(10) Patent No.: US 6,176,006 B1
(45) Date of Patent: Jan. 23, 2001

(54) ROD LOCK AND UNLOCK MECHANISM FOR A MECHANICAL TUBE EXPANDER

(75) Inventors: James G. Milliman; Derrick S. Small; Rocky L. Smith, all of Sturgis, MI (US)

(73) Assignee: Burr Oak Tool and Gauge Company, Inc., Sturgis, MI (US)

( * ) Notice: Under 35 U.S.C. 154(b), the term of this patent shall be extended for 0 days.

(21) Appl. No.: 09/401,017

(22) Filed: Sep. 21, 1999

(51) Int. Cl.[7] ..... B23P 15/26
(52) U.S. Cl. ..... 29/727; 29/726; 29/723
(58) Field of Search ..... 29/726, 727, 723, 29/890.047

(56) References Cited

U.S. PATENT DOCUMENTS 4,734,972 * 4/1988 Hawkins ..... 29/723
4,771,536 * 9/1988 Vanderlaan et al. .
4,835,828 * 6/1989 York et al. .
4,980,966 1/1991 Milliman et al. ..... 29/727
5,220,722 6/1993 Milliman ..... 29/727
5,353,496 10/1994 Harman et al. ..... 29/727
5,432,994 * 7/1995 Tokura .

FOREIGN PATENT DOCUMENTS 1 259 173 10/1992 (IT) .

* cited by examiner

*Primary Examiner*—S. Thomas Hughes
*Assistant Examiner*—Anthony L. Green
(74) *Attorney, Agent, or Firm*—Flynn, Thiel, Boutell & Tanis, P.C.

(57) ABSTRACT

A mechanical tube expander for expanding tubes into interlocked relationship with fins. Structure is provided for in situ storage of the expander rods and facilitating use of selected expander rods during a cycle of operation.

22 Claims, 15 Drawing Sheets

ROD LOCK AND UNLOCK MECHANISM FOR A MECHANICAL TUBE EXPANDER

FIELD OF THE INVENTION

This invention relates to an improvement for mounting an in situ storing of expander rods of a mechanical tube expander, which expander is used for fixing fins on the tubes of tube and fin-type heat exchangers.

BACKGROUND OF THE INVENTION

Mechanical tube expander machines which have plural expander rods therein, which expander rods are capable of being removed from the machine when they are not to be used in the performance of an assembling task are known in the prior art, U.S. Pat. No. 4,980,966 being one representative example thereof. In addition, in situ storing of expander rods in a mechanical tube expander machine are also known, Italian Patent No. 1 259 173 being one representative example thereof. In addition, servicing the expander rod lock is time consuming and labor intensive because the structure holding the expander rods in place requires a major disassembly of components.

Accordingly, it is an object of the invention to provide a mechanical tube expander machine wherein the unused expander rods are capable of being stored in situ while the in use expander rods are employed in the task of fixing fins on the tubes of tube and fin-type heat exchangers.

It is a further object of this invention to provide in a mechanical tube expander machine, as aforesaid, a mechanism for the separate securing of the expander rods to the pressure plate and to the stored expander rod locking plate in a manner which will facilitate a close spacing between the expander rods as well as a quick servicing of each expander rod lock by allowing an easy removal of each expander rod locking mechanism out through the top of the mechanical tube expander machine.

It is a further object of the invention to provide in a mechanical tube expander machine, as aforesaid, a mechanism for locking each of the expander rods to the stored expander rod locking plate, which mechanism is arranged on an axis that is coaxial with the longitudinal axis of each of the expander rods.

It is a further object of the invention to provide a mechanical tube expander machine, wherein a selection of the expander rods not to be employed in the task of fixing fins on the tubes of tube and fin-type heat exchangers is accomplished manually from the end of each expander rod remote from the pressure plate and/or stored expander rod locking plate.

It is a further object of the invention to provide a mechanical tube expander machine, as aforesaid, wherein the unused expander tools and tips are also stored in situ.

SUMMARY OF THE INVENTION

The objects and purposes of the invention are met by providing a mechanical tube expander for expanding tubes into interlocked relationship with fins, the mechanical tube expander including a frame, structure for holding an assembly of fins loosely stacked on tubes on the frame and a device for reciprocating a pressure plate and expander rods secured thereto into and out of the aforesaid tubes to expand the tubes into an interlocked relationship with the fins that are stacked thereon. The mechanical tube expander additionally includes a stored expander rod locking plate which is reciprocal between first and second positions with respect to the pressure plate when the pressure plate is retracted from the assembly. A device is provided for releasably locking selected ones of the expander rods to the pressure plate. A further device is provided for releasably locking the remaining ones of the expander rods separate from the selected ones to the stored expander rod locking plate and only when the stored expander rod locking plate is in the first position located adjacent the pressure plate. The remaining ones of the expander rods are moved with the stored expander rod locking plate in response to a movement thereof from the first position to the second position thereof to thereby cause the remaining expander rods to remain free of a locked connection to the pressure plate so that only the selected ones of the expander rods are reciprocated with respect to the assembly. The further device includes a plurality of openings in the stored expander rod locking plate corresponding in number, spacing and arrangement to the number, spacing and arrangement of the expander rods, each of the openings coaxially receiving therein a fluid operating detent activating mechanism adapted to coaxially house an end of the expander rod adjacent a detent receiving mechanism. Each fluid operated detent activating mechanism has reciprocal first and second operative positions and is selectively operable independent of each other. The detent activating mechanism, when in the first operative position thereof, includes a device for forcibly locating a detent of the detent activating mechanism in the detent receiving mechanism to prevent removal of the expander rod from the detent activating mechanism while simultaneously maintaining the coaxial relationship between the opening and the expander rod. The second operative position of the further device facilitates a withdrawal of the detent out of the detent receiving mechanism thereby facilitating removal of the expander rod from the detent activating mechanism.

DETAILED DISCUSSION

Figure 1:
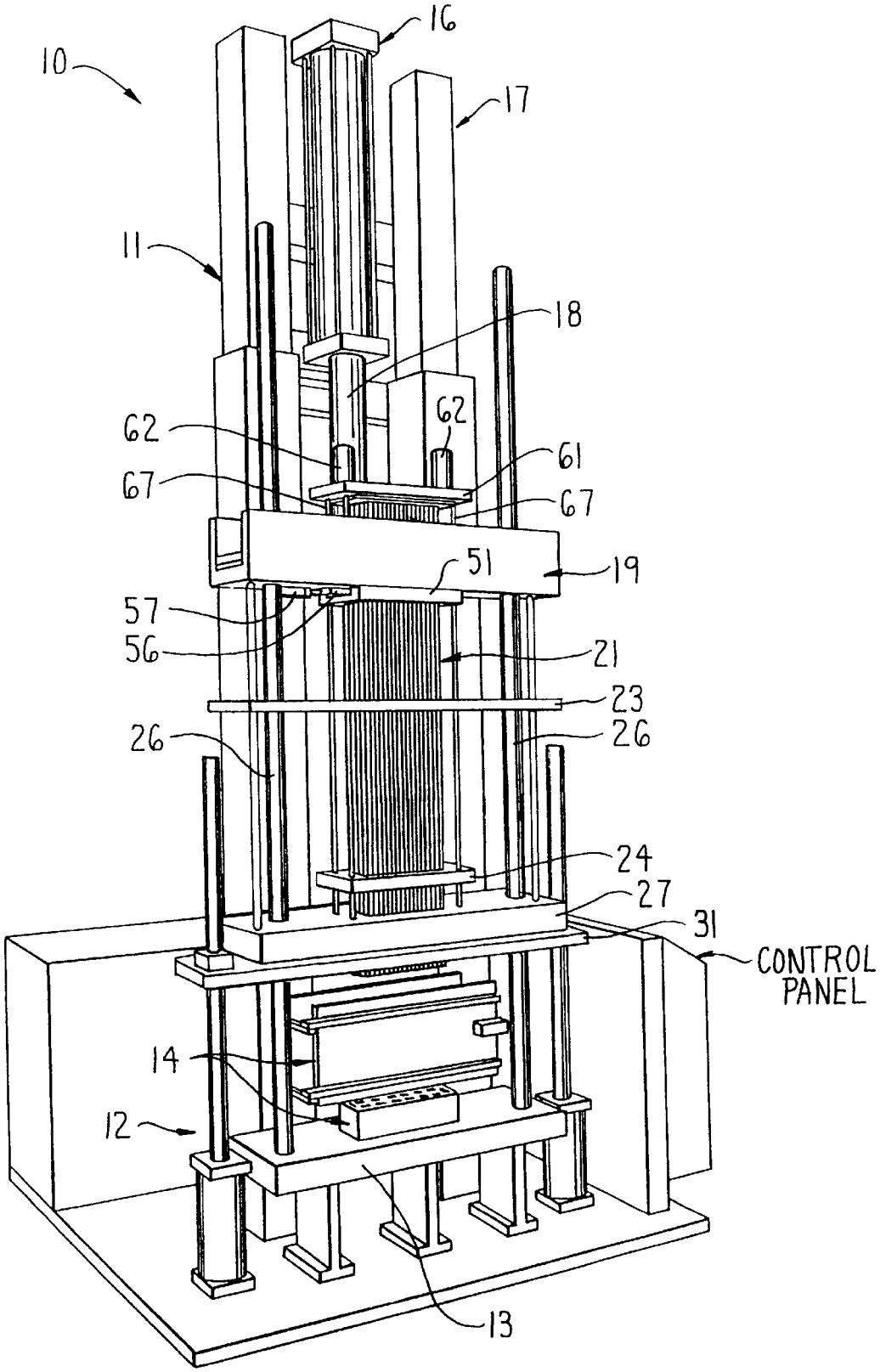
FIG. 1 is an isometric view of a mechanical tube expander embodying the invention.

Certain terminology will be used in the following description for convenience in reference only and will not be limiting. The words "up", "down", "right" and "left" will designate directions in the drawings to which reference is made. The words "in" and "out" will refer to directions toward and away from, respectively, the geometric center of the device and designated parts thereof. Such terminology will include derivatives and words of similar import.

The invention disclosed herein is adaptable for use with many varieties of mechanical tube expanders, of which the mechanical tube expanders disclosed in U.S. Pat. Nos. 5,220,722 and 5,353,496 are representative examples. The disclosure in the aforesaid two patents is incorporated herein by reference. The mechanical tube expander 10 illustrated in FIG. 1 includes an upstanding frame 11 having oriented adjacent the lower end 12 thereof a base plate 13 having conventional structure 14 for holding on the base plate 13 and assembly of fins and plural tubes, the fins being loosely stacked on the tubes and supported by the aforesaid structure 14.

Figure 8:
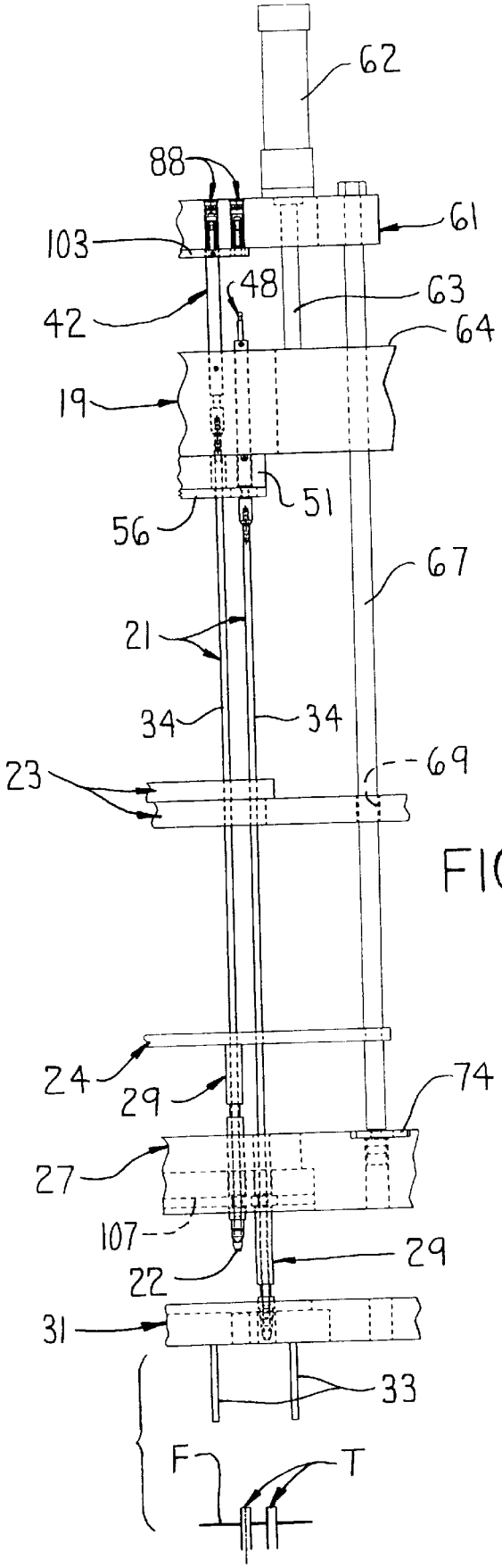
FIG. 8 is a view similar to FIG. 3 but with the components being illustrated in a second position thereof.
Figure 13:
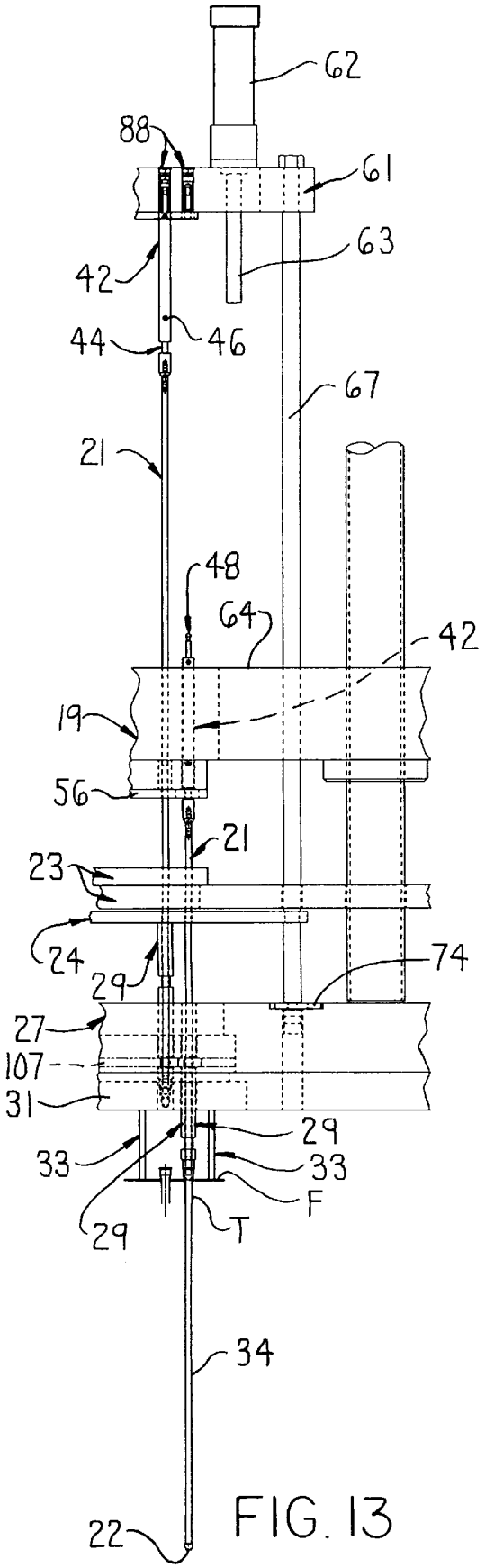
FIG. 13 is a view like FIGS. 3 and 8 but with the components being in a third position thereof.

A ram drive cylinder 16 is mounted on the upstanding frame 11 adjacent the upper end 17 thereof. The ram drive cylinder 16 has an elongate ram 18 whose longitudinal axis extends vertically. The lower end of the ram 18 is secured to a pressure plate 19 which carries thereon a plurality of expander rods 21. The expander rods 21 have parallel axes and each of the axes are aligned with an axis of a selected one of the tubes T (FIGS. 8 and 13). Each expander rod 21 has at a lower end thereof an enlarged tube-expanding tip 22 (FIG. 13). When the ram drive cylinder 16 is activated, the ram 18 will reciprocally drive the pressure plate 19. Any expander rods connected to the pressure plate l9 will also be reciprocally driven into the aligned tubes T so that the enlarged tube-expanding tip 22 will expand the tubes T so as to become fixedly engaged with the fins previously loosely stacked on the aforesaid tubes. The enlarged tube-expanding tips 22 are also known in the art as expander bullets. As illustrated in FIG. 1, the expander rods 21 extend through guide plates 23 and 24. Vertical guide rods 26 are provided for guiding the reciprocating movement of the pressure plate 19 and other reciprocal parts of the mechanical tube expander 10.

The mechanical tube expander 10 also includes an expander plate 27 having a plurality of through holes 28 (FIG. 6) therein corresponding in number, spacing and arrangement to the number, spacing and arrangement of the expander rods 21. A tube flaring tool 29 is received in each of the openings 28 in the expander plate 27. The structure utilized to affix each tube flaring tool 29 to the expander plate 27 will be described in more detail below.

A stripper plate 31 (FIG. 3) is oriented beneath the expander plate 27 and has a plurality of holes 32 extending therethrough which correspond in number, spacing and arrangement to the number, spacing and arrangement of the expander rods 21. The holes 32 are each adapted to allow the lower most end of each tube flaring tool 29 to pass therethrough so as to facilitate engagement thereof with the upper end of the tubes T. A plurality of stripper pins 33 project downwardly from the underside of the stripper plate 31 with the lower most ends of the stripper pins 33 terminating in a plane and being adapted to engage the uppermost fin F so as to facilitate retraction of each of the tube flaring tool 29 from their engagement with a respective tube T.

As thus far described, the mechanical tube expander 10 is of conventional structure. The details of its structure and operation are well known and, accordingly, it is believed unnecessary to describe the mechanical tube expander in greater detail. It will be understood that the invention can be employed with a wide variety of different mechanical tube expanders, including ones for expanding hairpin bent tubes and ones for expanding straight tubes, and that the invention is not to be limited to the specific press illustrated in FIG. 1.

Figure 2:
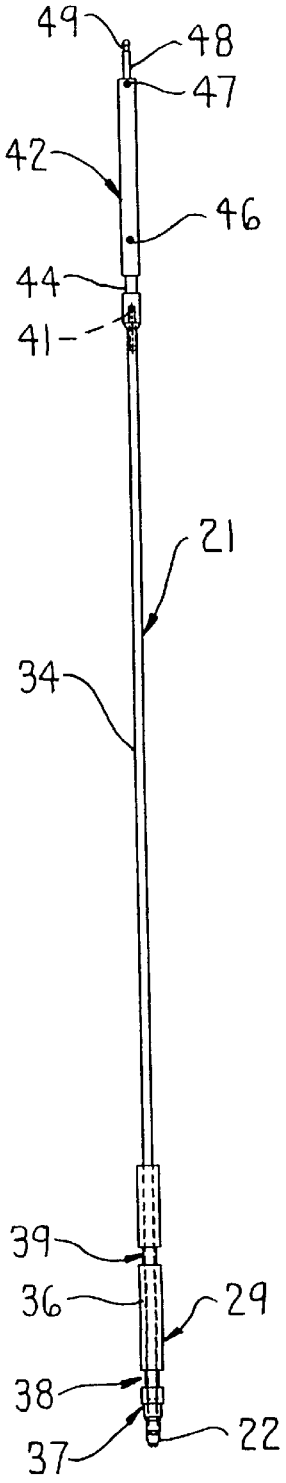
FIG. 2 is a view of an elongate expander rod embodying the invention.
Figure 15:
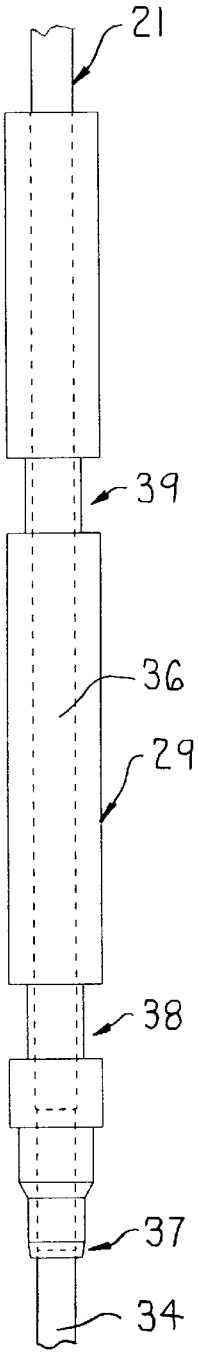
FIG. 15 is an enlarged view of the lower portion of the expander rod illustrated in FIG. 2, particularly, the tube flaring tool.

Turning now to the features of the mechanical tube expander 10 that distinguish it from the known prior art, each of the expander rods 21 (FIG. 2) includes an elongate rod 34 having the aforesaid expander bullet 22 at the lower most end thereof and the aforesaid tube flaring tool 29 sleevable and slidably mounting over the elongate rod 34, the expander bullet 22 being of a sufficient size such as to prevent the tube flaring tool 29 from sliding off the lower end of the elongate rod 34. The tube flaring tool 29 (See also FIG. 15) includes an elongate tube 36 having a conventional tube flaring structure 37 at the lower end thereof. The elongate tube 36 has two vertically separated sections of reduced diameter, namely, a lower reduced diameter section 38 and oriented thereabove a further reduced diameter section 39.

Figure 14:
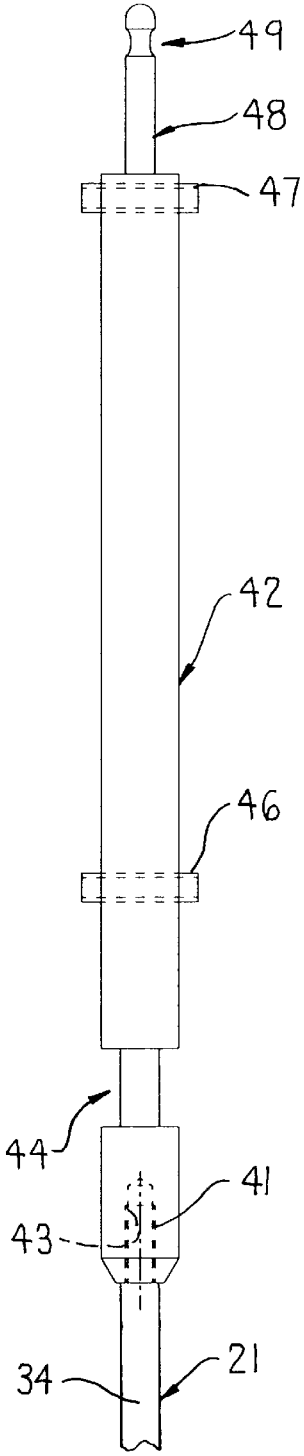
FIG. 14 is an enlarged view of the upper end portion of the expander rod illustrated in FIG. 2.

The upper end of the elongate rod 34 has an externally threaded part 41. An adaptor member 42 is provided and has an internally threaded socket 43 (FIG. 14) at the lower end thereof adapted to threadedly receive therein the externally threaded part 41 of the elongate rod 34. The adaptor member 42 has, immediately above the socket 43 a reduced diameter section 44. The adaptor member 42 also has a pair of vertically spaced crosswise extending pins 46 and 47 both oriented above the reduced diameter section 44 and both having an axis intersecting the longitudinal axis of the elongate rod 21. The purpose of the pins 46 and 47 will be set forth below. The upper end of the adaptor member 42 terminates in an elongate locking probe 48 having a reduced diameter detent receiving recess in the form of an annular groove 49 therein.

Figure 5:
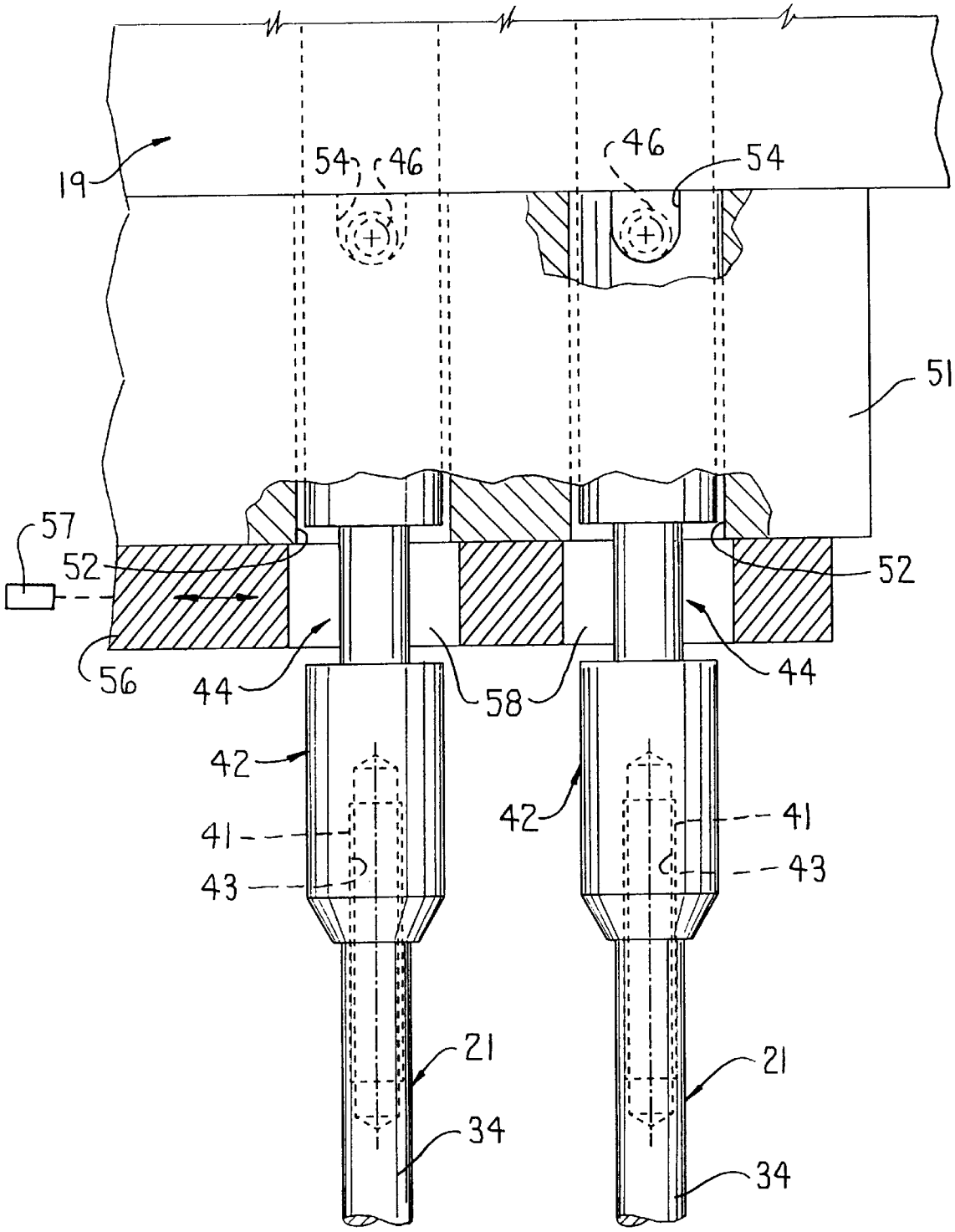
FIG. 5 is an enlarged fragment, partially sectioned, of a portion of FIG. 3.

A support plate 51 (FIGS. 3 and 5) is secured to the underside of the pressure plate 19 and is moveable therewith. The support plate 51 has a plurality of holes 52 extending therethrough and correspond in number, spacing and arrangement to the number, spacing and arrangement of the expander rods 21. The upper ends of each of the holes 52 open into an enlarged through opening 53, also known as a burnout, in the pressure plate 19. Each of the holes 52 in the support plate 51 have a recess 54 in the wall thereof adjacent the juncture between the support plate 51 and the pressure plate 19. The recesses 54 open upwardly and form a cradle for the crosswise extending pins 46 on the adaptor members 42 on the upper end of the expander rods 21 as illustrated in FIG. 5. As a result, vertical movement of the expander rods 21 relative to the support plate 51 below the position illustrated in FIG. 1 (and FIG. 5) is not possible due to the pins 46 resting on the cradle formed by each of the recesses 54. Further, rotation of the expander rods 21 is prevented.

Figure 3:
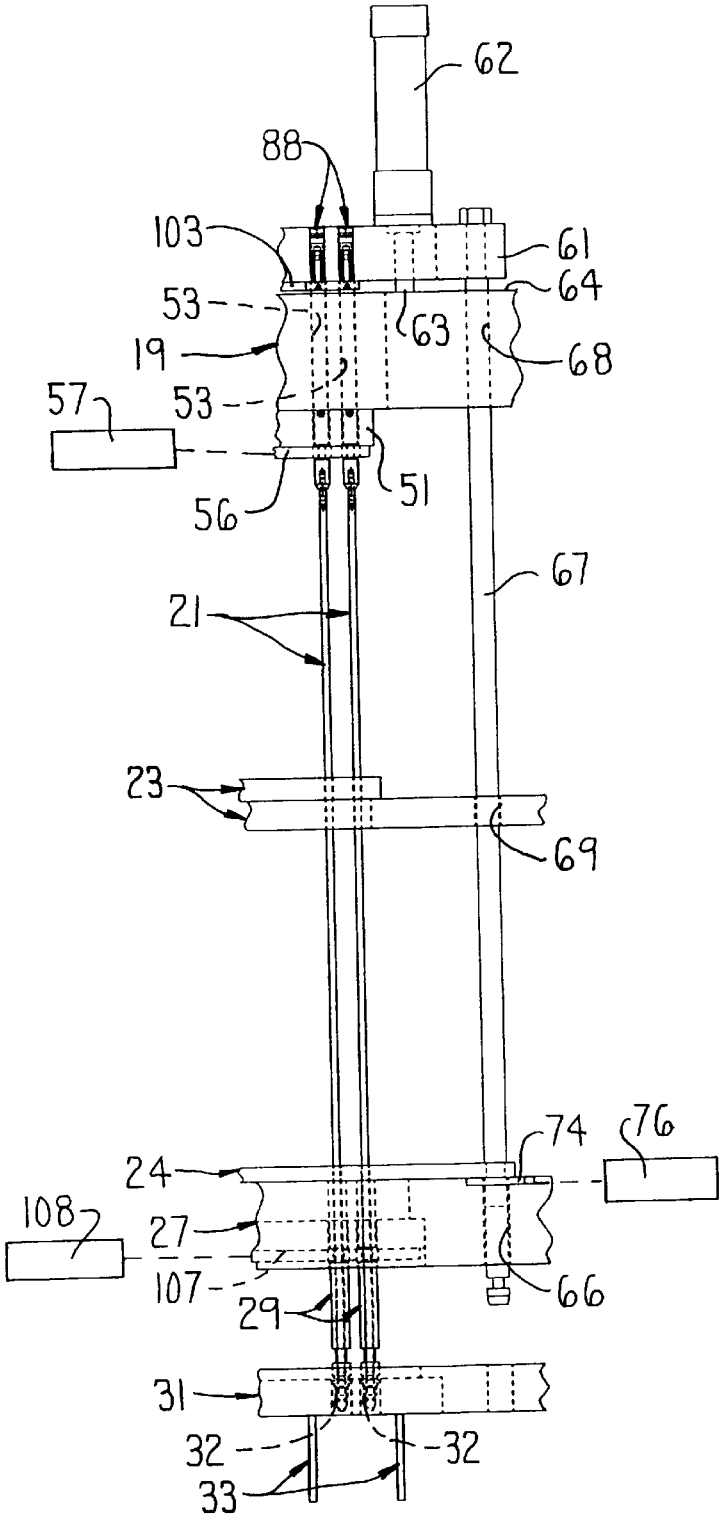
FIG. 3 is an enlarged fragmentary illustration of a section of the mechanical tube expander and with the components oriented in a first position.

A slide plate 56 is slidably supported on the underside of the support plate 51 for left and right movement (FIG. 5), the movement being facilitated by connection to a fluid, here hydraulic, cylinder 57 schematically illustrated in FIG. 3. The slide plate 56 has a plurality of through holes 58 therein each of a sufficient diameter to facilitate movement of the adaptor member 42 therethrough when the pins 46 are lifted out of the cradles defined by the recesses 54. This lifting motion will be described below. It is to be noted that in the FIG. 5 illustration, the holes 58 are axially aligned with the axially aligned holes 52 extending through the support plate 51.

A stored expander rod locking plate 61 is provided which, in this particular embodiment, is oriented above the pressure plate 19 as illustrated in FIGS. 1 and 3. A plurality of fluid, here hydraulic, cylinders 62 are secured to and extend upwardly from the upper surface of the stored expander rod locking plate 61 as illustrated in FIGS. 1 and 3. The rod 63 of each of the hydraulic cylinders 62 rests on the upper surface 64 of the pressure plate 19. In the alternative, the hydraulic cylinders 62 can be secured to the top surface of the pressure plate 19 so that the respective rods 63 thereof engage the underside of the stored expander rod locking plate 61.

Figure 7:
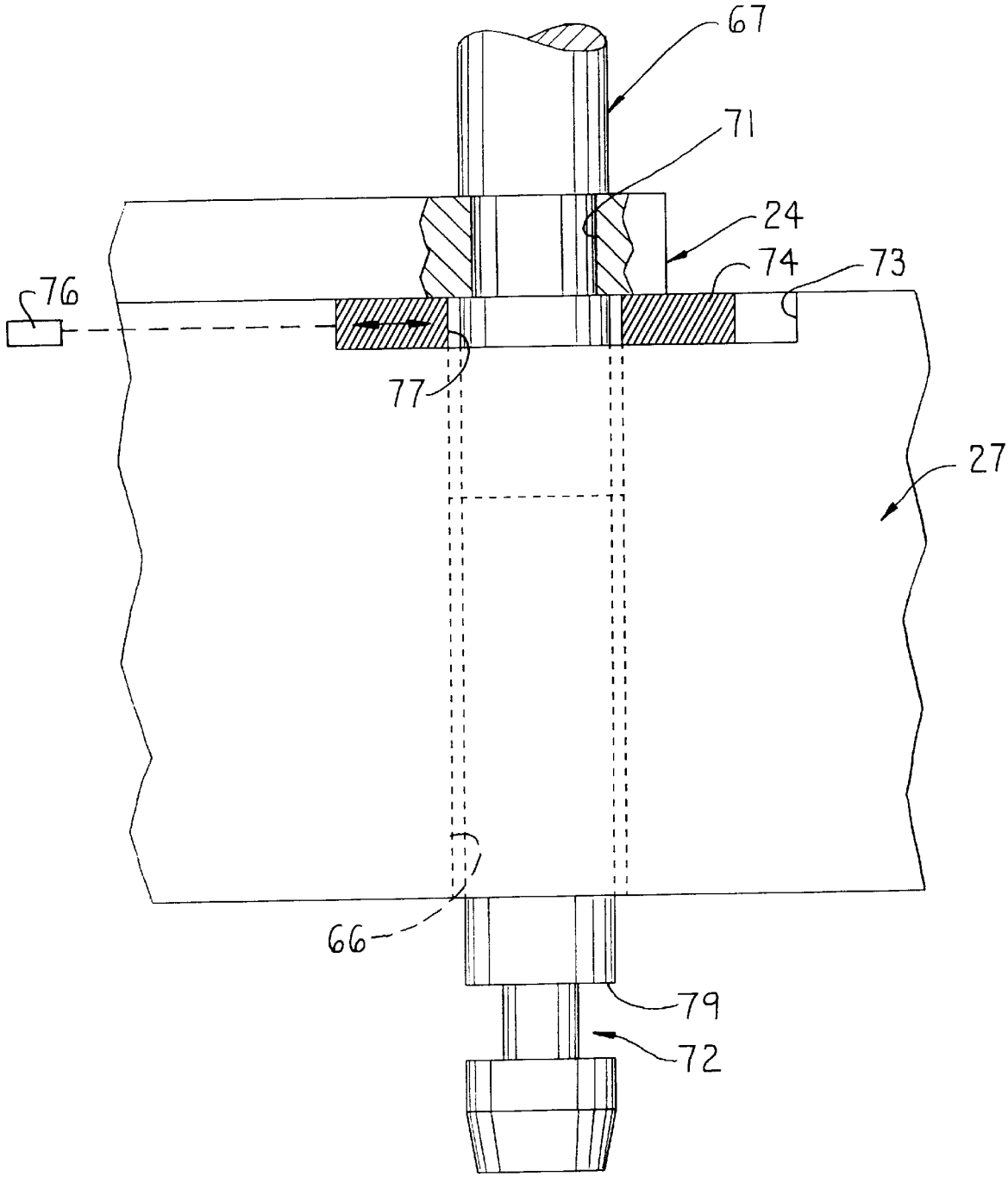
FIG. 7 is an enlarged fragment, partially sectioned, of a portion of FIG. 3.

The expander plate 27 has plural holes 66 (FIG. 3) extending therethrough, which holes 66 (FIG. 7) are laterally offset from the holes through which the expander rods 21 extend. An elongate rod 67 is fixedly secured to the stored expander locking plate 61, extends downwardly therefrom through a hole 68 in the pressure plate 19, a hole 69 in the guide plate 23, a hole 71 in the guide plate 24 and through the hole 66 in the expander plate 27. A reduced diameter section 72 is provided adjacent the lower terminal end of the elongate rod 67.

Figure 12:
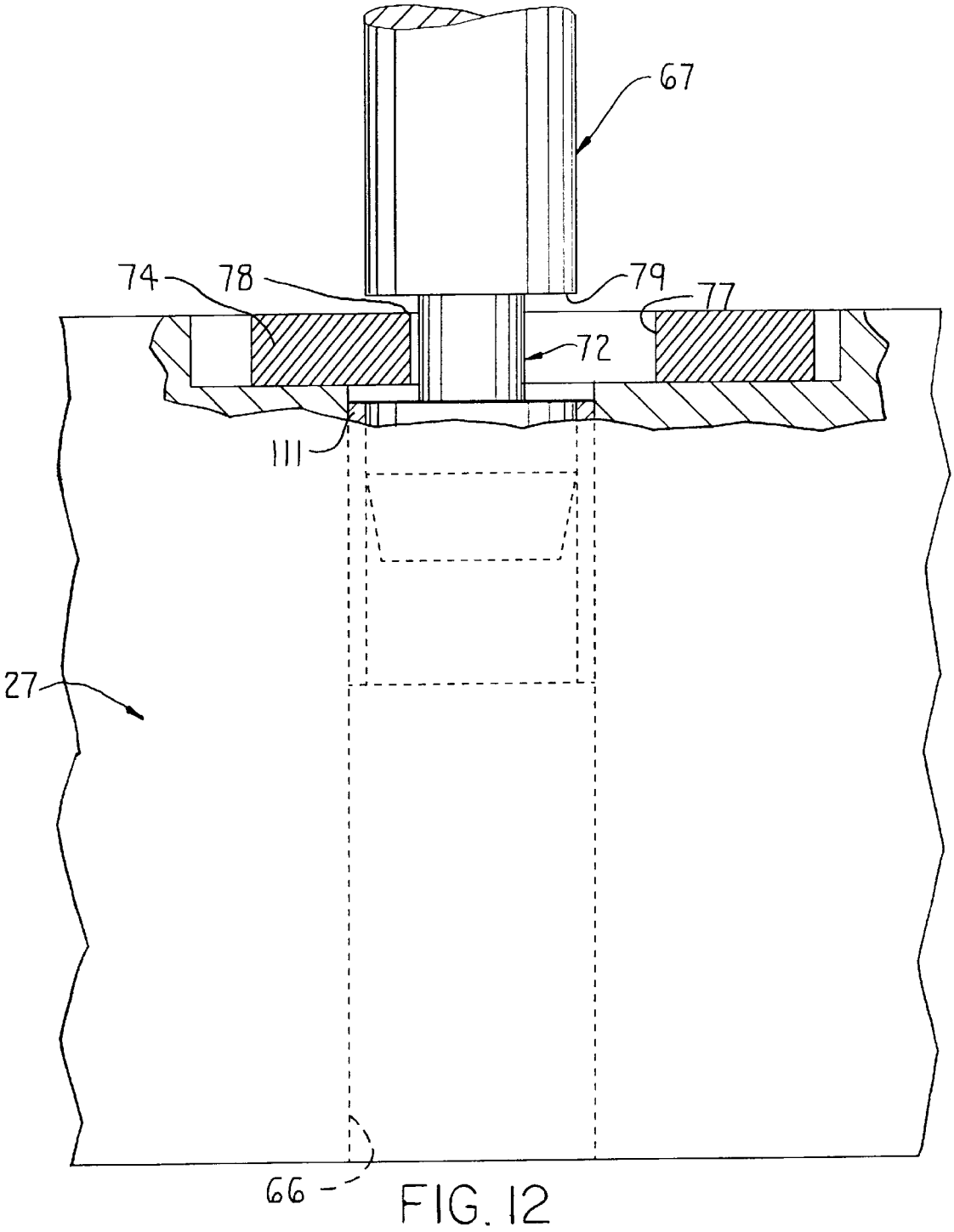
FIG. 12 is an enlarged fragment, partially sectioned, of a portion of FIG. 8.

A recess 73 is provided in the upper surface of the expander plate 27 and a plate 74 is reciprocally mounted in the recess 73 and is driven for reciprocal movement by a fluid, here hydraulic, cylinder 76 schematically illustrated in FIG. 3. A through hole 77 is provided in the slide plate 74 and receives therethrough the elongate rod 67. When the piston rod 63 is extended to the position illustrated in FIG. 8 so as to facilitate a lifting of the stored expander rod locking plate 61 relative to the pressure plate 19, the elongate rod 67 will also be lifted so as to draw the reduced diameter section 72 thereof up inside the hole 66 to the position illustrated in FIG. 12 at which time the hydraulic cylinder 76 is actuated to slide the slide plate 74 rightwardly to orient an edge 78 of the hole 77 in the slide plate 74 beneath the downwardly facing surface 79 of the reduced diameter section 72 in the elongate rod 67.

Figure 4:
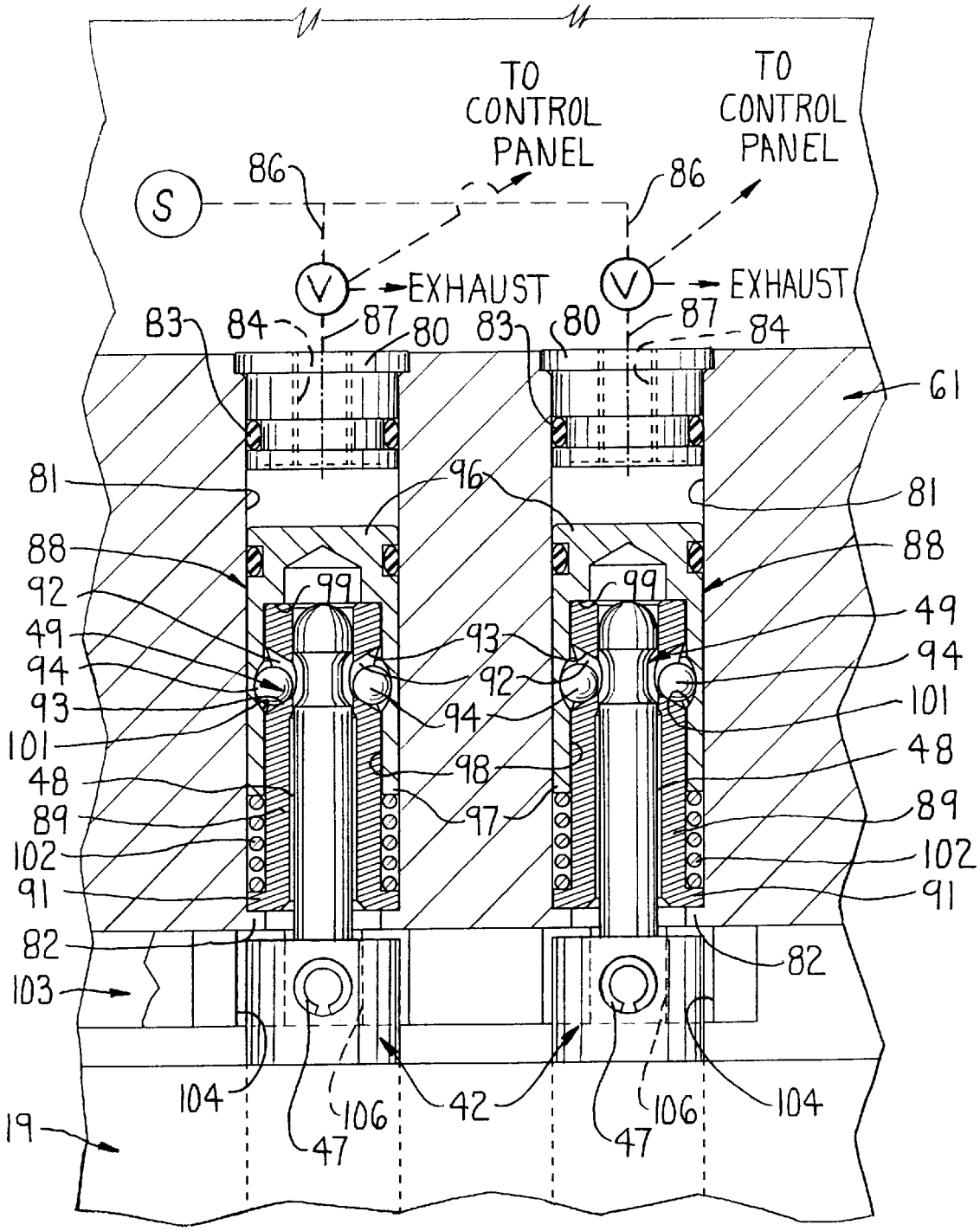
FIG. 4 is an enlarged fragment, partially sectioned, of a portion of FIG. 3.

The stored expander rod locking plate 61 has a plurality of holes 81 (FIG. 4) therein, here through holes 81, corresponding in number, spacing and arrangement to the number, spacing and arrangement of the expander rods 21. The holes 81 are coaxially arranged with the holes 52 in the support plate 51. The holes 81 are of a uniform diameter and have at the lower ends thereof a radially inwardly extending flange 82 (FIG. 4). The upper end of each of the holes 81 is closed off by a plug 80 which has an annular groove in the periphery thereof receiving therein an o-ring 83 compressed between the bottom wall of the annular groove and the wall surface of the hole 81. A central hole 84 extends through the plug 80.

A source S of pressurized fluid, here air, is connected through conduits 86 provided in, for example, a manifold to a plurality of individual valves V which are connected through respective conduits 87 to the aforesaid holes 84 in the plugs 80. Each valve includes an EXHAUST port for permitting fluid to flow from the conduits 87 to the EXHAUST port. Each of the valves V are independently controllable from individually manually actuated controls (such as push buttons not shown) provided at the CONTROL PANEL illustrated in FIG. 1.

Each of the holes 81 in the stored expander rod locking plate 61 house therein a rod locking mechanism 88. Each rod locking mechanism 88 includes an elongate detent retaining sleeve 89 coaxially arranged within each hole 81 and having at a lower end thereof a radially outwardly extending flange 91 resting on the upper surface of the radially inwardly extending flange 82 at the lower end of each of the holes 81. Adjacent the upper end of the detent retaining sleeves 89 there is provided a pair of axially aligned detent receiving openings 92 with radially outwardly extending diverging walls 93. A detent ball 94 is received in each of the openings 92 and has a diameter sufficient to enable only a portion of the ball to project through the radially inner end of each of the openings 92.

Each rod locking mechanism 88 additionally includes a reciprocal piston 96 having an elongate sleeve-like section 97 telescoped over the periphery of the detent retaining sleeve 89. The interior 98 of the sleeve-like section 97 includes a radially inwardly extending shoulder 99 to facilitate engagement with the upper end of the detent retaining sleeve 89 to thereby limit the extent to which the piston 96 can move toward the detent retaining sleeve 89. An enlarged internal diameter section 101 is provided on the interior surface 98 of the sleeve-like section 97 and, when the shoulder 99 is in engagement with the upper end of the detent retaining sleeve 89, the section 101 is aligned with the openings 92 and the detent balls 94 oriented therein. A compression spring 102 is provided between the upper surface of the flange 91 and the lower edge of the sleeve-like section 97 of the piston 96 to urge the piston 96 toward the plugs 80.

If desired, an alternate rod locking mechanism 88A (FIG. 16) can be provided. The components of the alternate rod locking mechanism 88A are, for the most part, similar if not identical to the components illustrated in FIG. 4 and, as a result, the same reference numerals used above in regard to FIG. 4 have been used in FIG. 16 but with the suffix "A" added thereto.

Figure 16:
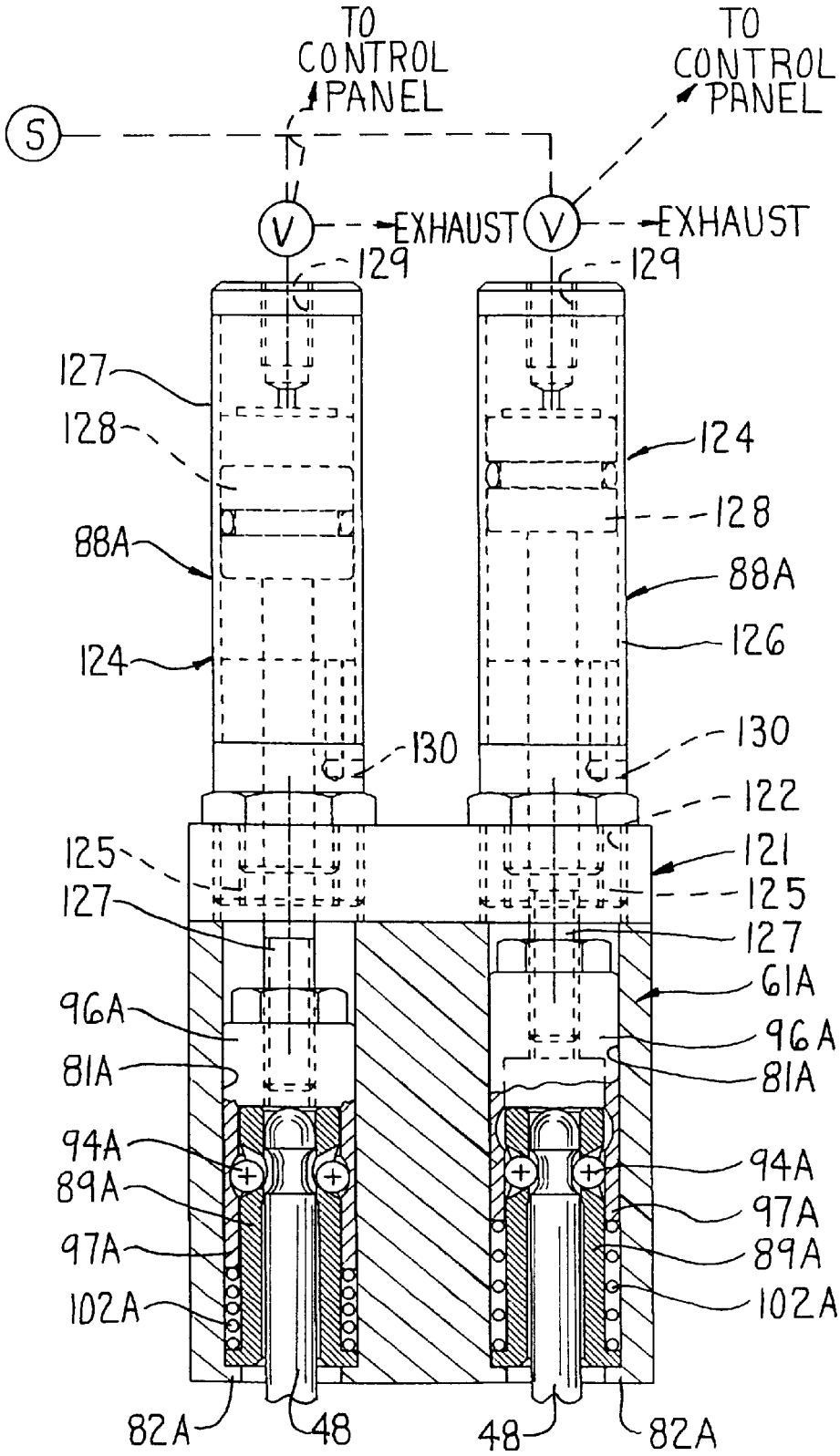
FIG. 16 is an alternate embodiment of the rod locking mechanism illustrated in FIG. 4.

Referring to FIG. 16, the rod locking mechanism 88A includes the stored expander rod locking plate 61A having a plurality of through holes 81A corresponding in number, spacing and arrangement to the number, spacing and arrangement of the expander rods 21. Secured to the top of the stored expander rod locking plate 61A is a mounting plate 121 having plural internally threaded through holes 122 axially aligned with the holes 81A in the stored expander rod locking plate 61A. The diameter of the holes 122 is larger than the diameter of the holes 81A.

The top of the pistons 96A each have an internally threaded hole 123 in the central portion of the upwardly facing surface thereof.

A plurality of fluid, here pneumatic, cylinders 124 are mounted to the mounting plate 121. More specifically, each pneumatic cylinder 124 has a housing 126 with an externally threaded nipple 125 threadedly received in the holes 122. The free end of each rod 127 of each pneumatic cylinder 124 extends into the holes 81A of the stored expander rod locking plate 61A and is threadedly received into the holes 123 to become secured to the pistons 96A.

A reciprocal piston 128 is provided in each pneumatic cylinder 124, which piston 128 is urged upwardly by the spring 102A. The source S of pressurized fluid, here air, is connected, as also shown in FIG. 4, through conduits 86A, valves V and additional conduits 87A to holes 129 in the upper ends of each of the pneumatic cylinders 124. The valves V are controlled in the same manner as has been described herein. Activation of a selected valve V will effect a supply of pressurized air to and through the hole 129 to urge the piston 128 downwardly as shown on the right side of FIG. 16. The underside of each piston 128 is connected to the atmosphere through a hole 130.

A rod antirotation plate 103 is secured to the underside of the stored expander rod locking plate 61. A plurality of through holes 104 are provided in the rod antirotation plate 103 and correspond in number, spacing and arrangement to the number, spacing and arrangement of the expander rods 21. Each of the holes 104 has an enlarged radially outwardly extending lobe 106 open at both the top and the bottom of the rod antirotation plate 103 to facilitate the receipt therein of the pin 47 on the adaptor member 42 oriented at the upper end of the expander rod 21. When the pin 47 is received in the lobes 106 of the openings 104, the pins 47 will prevent rotation of the expander rod 21. When the expander rods 21 are locked to the stored expander rod locking plate 61, the pins 47 will always be oriented in the lobes 106 to prevent rotation thereof.

A slide plate 107 (FIGS. 3 and 6) is reciprocally slidably mounted on the expander plate 27, the reciprocal motion being effected by a fluid, here hydraulic, cylinder 108. The slide plate 107 has a plurality of through holes 109 therein which correspond in number, spacing and arrangement to the number, spacing and arrangement of the expander rods 21. The diameter of each of the holes 109 is just slightly greater than the outer diameter of the tube flaring tools 29.

OPERATION

Although the operation of the structure described above will be understood from the foregoing description by skilled persons, a summary of such operation is now given for convenience.

FIG. 3 illustrates the mechanical tube expander 10 in its initial fully retracted position. In this position, it is possible to select those expander rods 21 that are to be used in the next cycle of operation of the mechanical tube expander. In this condition, the slide plate 56 (FIG. 5), the slide plate 74 (FIG. 7) and the slide plate 107 (FIG. 6) are all shifted to the left as illustrated in the aforesaid figures so that the respective holes therethrough are coaxially arranged with the expander rods 21. All of the valves V (FIG. 4) are activated by a command at the CONTROL PANEL to direct pressurized fluid through the openings 84 of the plugs 80 into the spacing between the plug 80 and the pistons 96 to urge the pistons 96 downwardly until the shoulders 99 thereof engage the upper ends of the detent retaining sleeves 89 against the urging of the springs 102 to orient the enlargements 101 so that they directly oppose a detent ball 94 thereby enabling all of the balls 94 to move radially outwardly under the force of gravity. The locking probe 48 at the upper end of each of the expander rods 21 is telescoped inside the detent retaining sleeves 89 so that the detent receiving recesses 49 thereof are aligned with the detent receiving openings 92 and the detent balls 94 oriented in the those openings.

Figure 9:
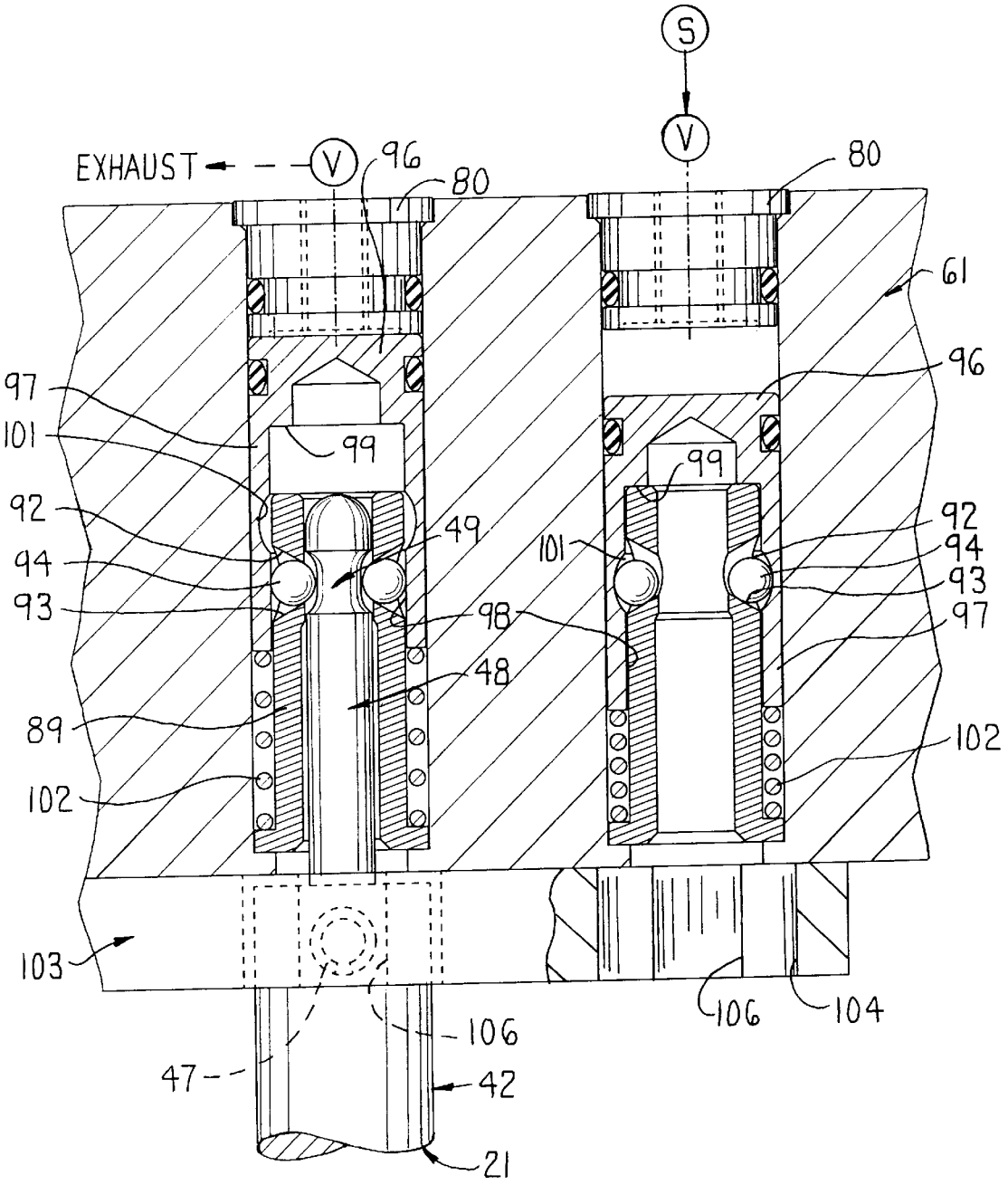
FIG. 9 is an enlarged fragment, partially sectioned, of a part of the structure illustrated in FIG. 8.

Thereafter, the machine operator will then select the expander rods that are to be used in the next cycle of operation of the mechanical tube expander 10. The operator selects via a touch screen interface on the CONTROL PANEL a button corresponding to a selected valve V. After having touched all of the buttons corresponding to each of the expander rods that are to be used in the next cycle of operation of the mechanical tube expander, the machine operator will thereafter push an "enter" button which will then cause those valves V corresponding to buttons not touched by the machine operator to shift to connect the region between the plugs 80 and the pistons 96 to exhaust. This will enable the springs 102 to effect a shifting of the pistons 96 upwardly into engagement with the plugs 80. FIG. 9 illustrates a pair of side by side rod locking mechanisms 88 wherein the left most rod locking mechanism 88 has been shifted due to the fact that the expander rod 21 associated therewith is not to be utilized in the next cycle of operation. The expander rod 21 associated with the right most rod locking mechanism 88 is to be utilized in the next cycle of operation of the mechanical tube expander.

Thereafter, the cylinders 62 on top of the stored expander rod locking plate 61 are actuated so that the rods 63 thereof extend to the positions illustrated in FIGS. 1 and 8. The left most expander rod 21 (FIGS. 8 and 9) are lifted vertically upwardly with the stored expander rod locking plate 61. Of course, a lifting of the left most expander rod 21 also effects a lifting of the tube flaring tools 29 associated therewith. The elongate rods 67 connected to the stored expander rod locking plate 61 are also lifted so that the reduced diameter sections 72 adjacent the lower ends thereof is shifted from the FIG. 7 to the FIG. 12 position, namely, a position where the reduced diameter section 72 is oriented in the hole 77 in the slide plate 74.

Figure 17:
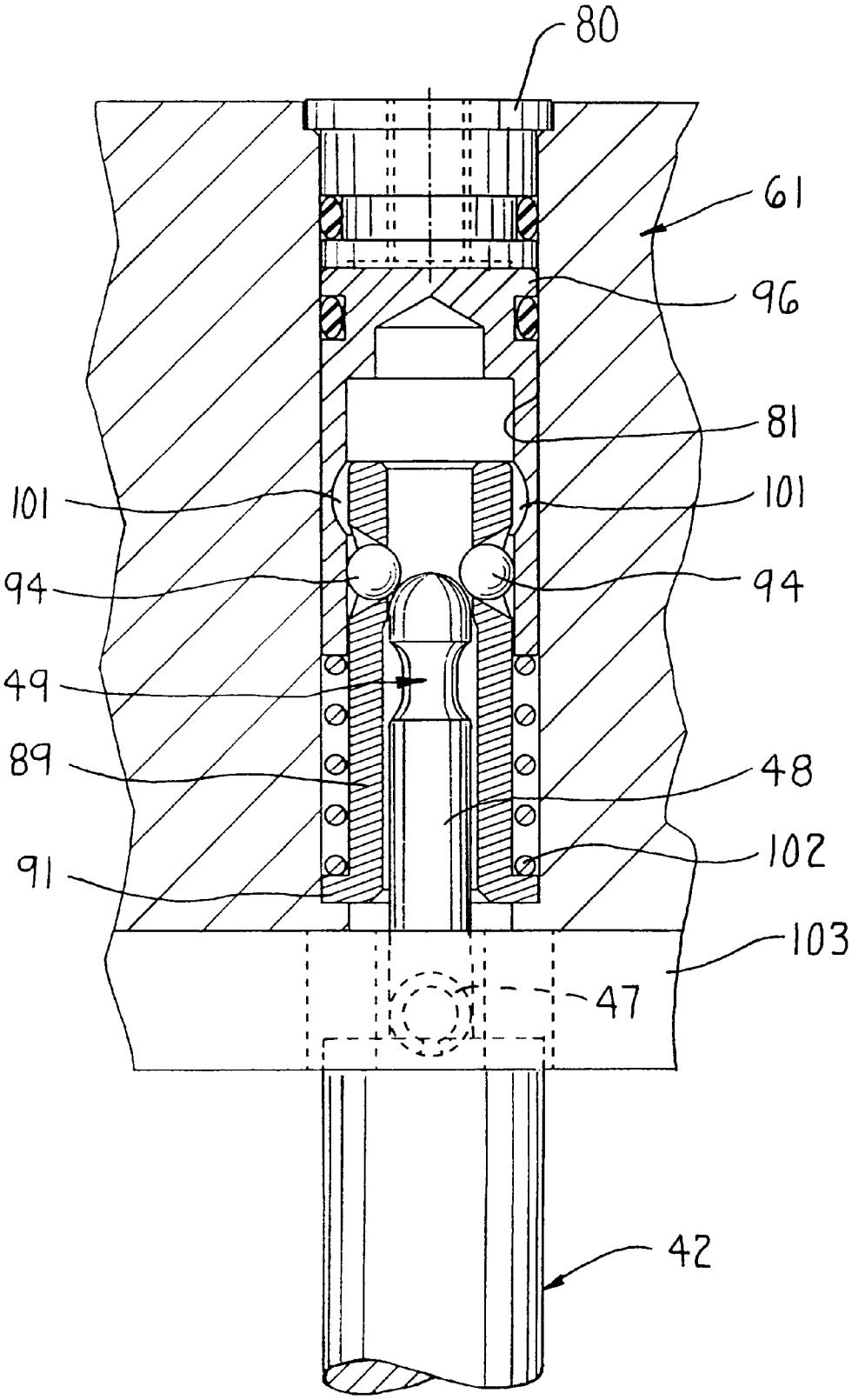
FIG. 17 is a fragmentary view, in section, of the stored expander rod locking plate with a probe partially inserted into the rod locking mechanism.
Figure 18:
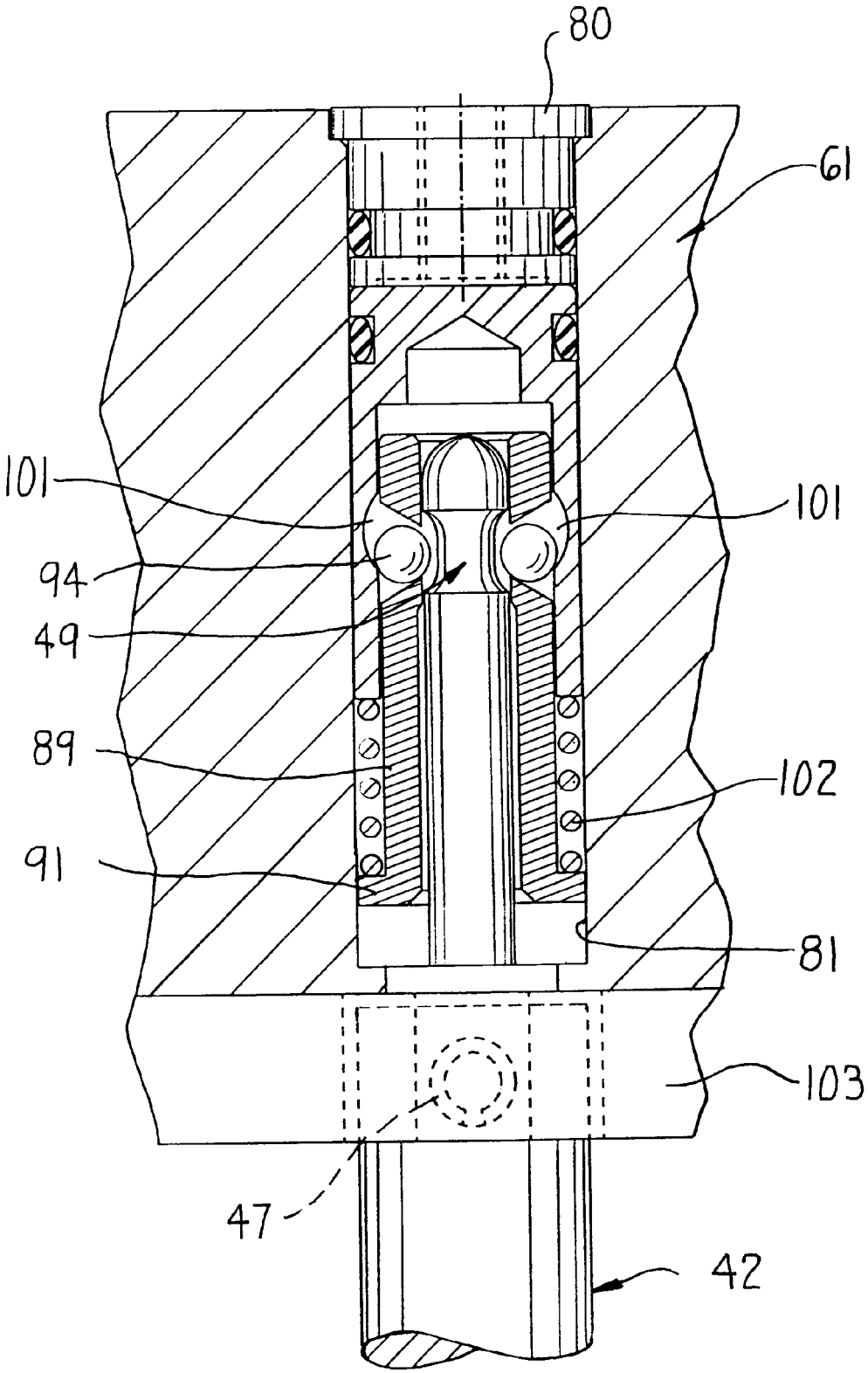
FIG. 18 is a view like FIG. 17, but with the probe inserted further into the rod locking mechanism.

If at this point it is determined that additional expander rods 21 are in need of being connected to the stored expander rod locking plate 61, those valves V that are currently supplying pressurized fluid to the region between the plugs 80 and the pistons 96 will first be actuated to connect the aforesaid regions to exhaust. Thereafter, the selected additional expander rods 21 can be manually selected by the operator by pushing up on each expander rod 21 so selected to cause the probe 48 to enter the interior of the detent retaining sleeve 89. When the head (upper end) of the probe 48 engages the balls 94 (FIG. 17), the continued application of upwardly directed force by the operator on the expander rod 21 will cause the detent retaining sleeve 89 to be lifted (see FIG. 18) against the urging of the spring 102 until the balls 94 become aligned with the enlarged internal diameter section 101. At this point, the balls 94 will move radially outwardly to allow the head end of the probe 48 to continue to move upwardly past the balls 94 while simultaneously the detent retaining sleeve 89 will be driven by the spring 102 downwardly to move the balls into the reduced diameter section 49 on the probe 48 to the position illustrated in the left side of FIG. 9.

Actuation of the hydraulic cylinder 76 will effect a shifting of the slide plate 74 to the right (FIG. 12) to orient an edge 78 of the hole 77 beneath the undersurface 79 of the reduced diameter section 72 to prevent relative vertical movement between the rods 67 and the slide plate 74. If needed, a bushing 111 (FIG. 12) can be provided between the lower end portion of the rod 67 and the interior surface of the holes 66 to limit relative movement between the rods 67 and the expander plate 27.

Figure 6:
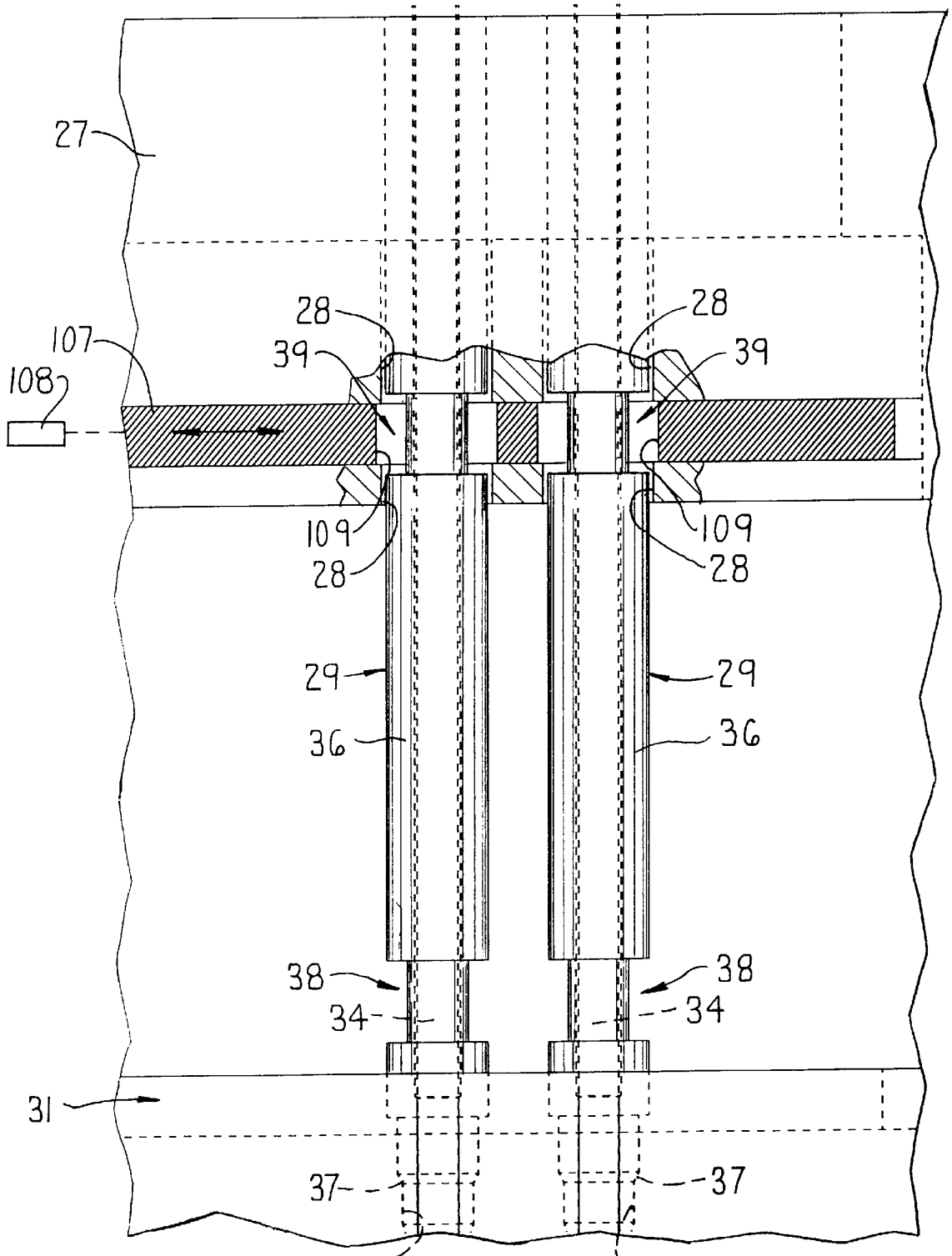
FIG. 6 is an enlarged fragment, partially sectioned, of a portion of FIG. 3.
Figure 10:
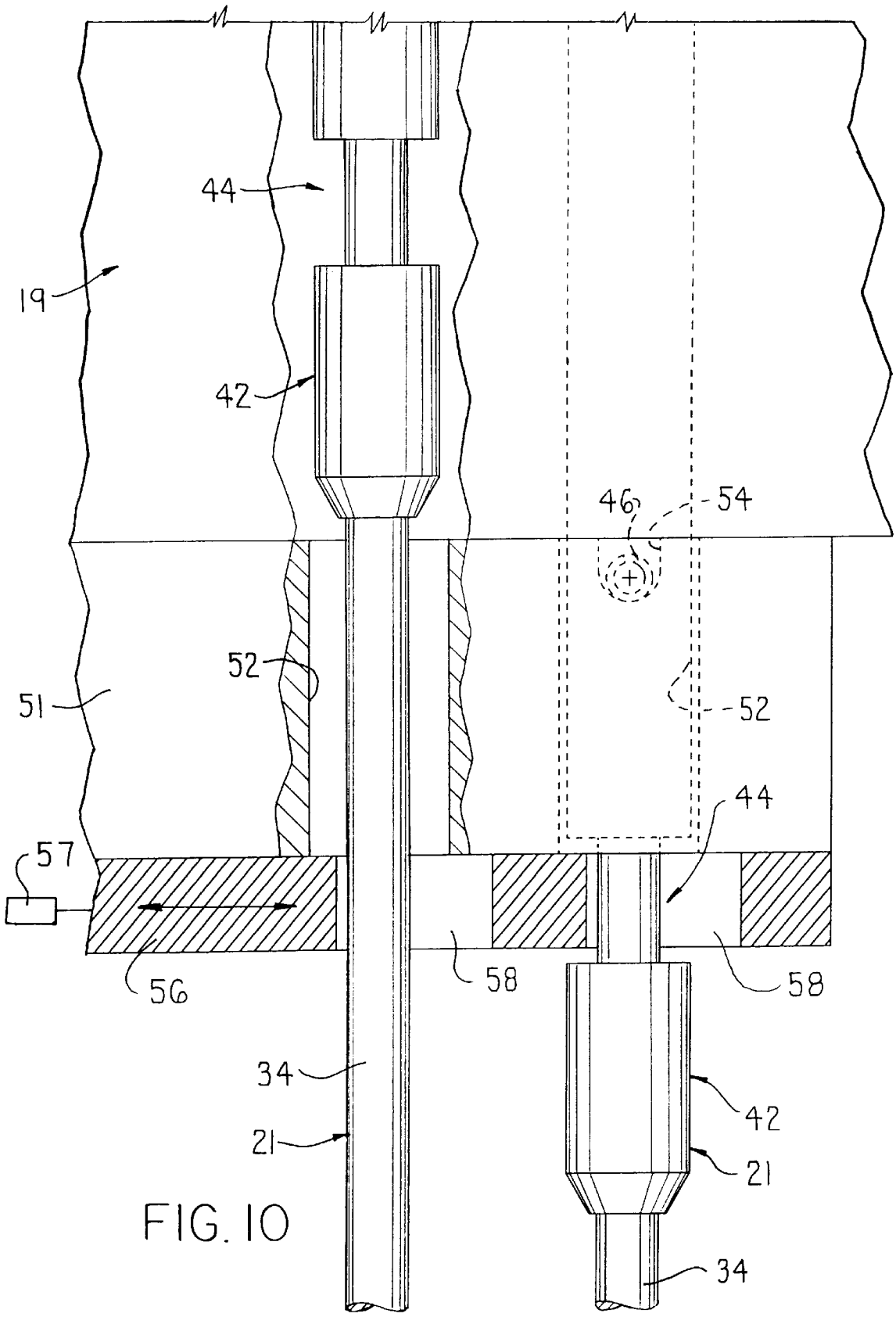
FIG. 10 is an enlarged fragment, partially sectioned, of a portion of FIG. 8.
Figure 11:
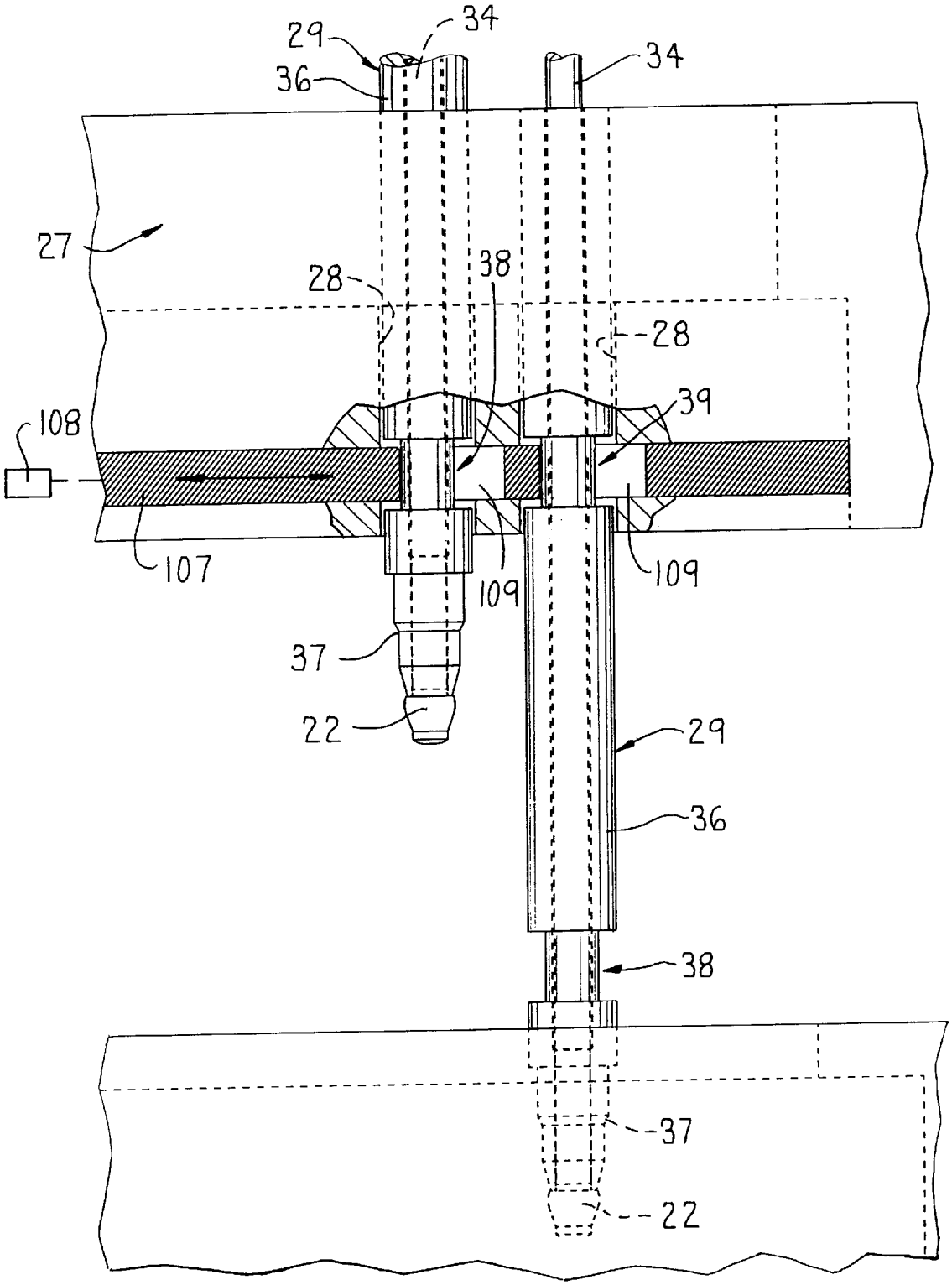
FIG. 11 is an enlarged fragment, partially sectioned, of a portion of FIG. 8.

A lifting of the left most expander rod 21 (FIG. 8) also orients the elongate rod 34 of the expander rod 21 in the hole 58 in the slide plate 56. The reduced diameter section 44 that was previously oriented in the hole 58 (FIG. 5) has now been lifted upwardly above the slide plate 56 as illustrated in FIG. 10. Similarly, the tube flaring tools 29 associated with the expander rods connected to the stored expander rod locking plate 61 have also been lifted (FIG. 11). That is, FIG. 6 illustrates the initial position of the expander tools 29 whereas FIG. 11 illustrates the left most expander rod and associated tube flaring tool 29 as having been lifted so that the reduced diameter section 38 has now been moved into the hole 109. Thereafter, the hydraulic cylinders 57 and 108 are activated to effect a shifting of the respective slide plates 56 and 107 rightwardly from the positions illustrated in FIGS. 5 and 6 to the positions illustrated in FIGS. 10 and 11. In other words, the unused and stored expander rod 21 also carries into an in situ stored location, namely, on the expander plate 27, the associated tube flaring tool 29. In the illustration in FIG. 10, a shifting of the slide plate 56 will effect a locking of the right most expander rod 21 to the pressure plate 19 whereas the left most expander rod remains lifted and connected to the stored expander rod locking plate 61 so that the pressure plate 19 can move independently of the left most expander rod 21.

It is important to note that since the rod antirotation plate 103 is fixed to the underside of the stored expander rod locking plate 61, the pins 47 on the expander rod locked to the stored expander rod locking plate 61 remain in the lobes 106 and the expander tools 21 associated therewith are prevented from rotating. The pins 46 on those same expander rods locked to the stored expander rod locking plate 61 are lifted out of their respective cradles formed by the recesses 54. For those expander rods 21 that are now connected to the pressure plate 19 by reason of the slide plate 56 having been slid rightwardly to the FIG. 10 position by activation of the hydraulic cylinder 57, the pins 46 remain nestled in the cradle defined by the recesses 54 and, therefore, prevent rotation of the expander rods.

Thereafter, the mechanical tube expander 10 can be operated through a cycle of operation to and including the position illustrated in FIG. 13. Thereafter, the pressure plate 19 will be returned to its initial position illustrated in FIG. 3 to enable a repeat cycle forming a new fin and tube assembly and/or a selection of other expander rods to be utilized in the next cycle of operation.

If the stored expander rod locking plate 61 or 61A is returned to the initial position thereof adjacent the pressure plate 19, the slide plate 74, of course, needs to be shifted to the left so that the elongate rod 67 can slide relative to the expander plate 27 and simultaneously cause the guide plate 24 to push the expander tools 29 previously raised (FIG. 8) all to the position shown in FIG. 3.

If service to an expander rod 21 is ever required necessitating replacement, the replacement task can be accomplished by unscrewing the elongate rod 34 from the adaptor member 42 and lowering the elongate rod from the machine. The adaptor member 42 will be prevented from rotating both during the unscrewing task and during the task of screwing a new and/or replacement rod thereto by the relationship between the pins 46 and/or 47 and the recesses 54 and lobes 106, respectively. If it is necessary to thereafter remove and/or replace the adaptor member 42, the pressure plate 19 needs to be shifted downwardly from the FIG. 8 to the FIG. 13 position so that the appropriate adaptor member 42 now disconnected from an elongate rod 34 can simply be lifted up and out of the machine.

To service the rod locking mechanisms 88, all of this activity can occur from the top of the stored expander rod locking plate 61. More specifically, and referring to FIG. 4 (or FIG. 9), the plugs 80 are held to the plate 61 by an overlapping enlarged head of a screw (not illustrated). By removing the aforesaid screw, the associated plug 80 can be removed. The detent retaining sleeve 89, the balls 94, the piston 96 and the spring 102 can thereafter be lifted out the opening 81.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In a mechanical tube expander for expanding tubes into interlocked relationship with fins, comprising:

a frame;

means for holding on said frame an assembly of fins loosely stacked on tubes;

a pressure plate carrying a plurality of expander rods with parallel axes and which are aligned with the tubes, said expander rods having tube-expanding means at one end thereof and detent receiving means close to the opposite end thereof; and means for reciprocating said expander rods with respect to said assembly in order to expand the tubes into interlocked relationship with the fins that are stacked thereon, the improvement comprising:

a stored expander rod locking plate;

means for reciprocating said stored expander rod locking plate between first and second positions with respect to said pressure plate when said pressure plate is retracted from said assembly;

first means for releasably locking selected ones of said expander rods to said pressure plate;

second means for releasably locking the remaining ones of said expander rods separate from said selected ones to said stored expander rod locking plate and only when said stored expander rod locking plate is in said first position thereof positioned adjacent said pressure plate, said remaining ones of said expander rods being moved with said stored expander rod locking plate in response to a movement thereof from said first position to said second position thereof to thereby cause said remaining expander rods to remain free of a locked connection to said pressure plate so that only said selected ones of said expander rods are reciprocated with respect to said assembly, said second means comprising:

a plurality of openings in said stored expander rod locking plate corresponding in number, spacing and arrangement to the number, spacing and arrangement of said expander rods, each said opening having an axis that is coaxial with the axis of respective other of said openings and coaxially receiving therein a fluid operated detent activating mechanism adapted to coaxially house said opposite end of said expander rod having said detent-receiving means therein, each said fluid operated detent activating mechanism having reciprocal first and second operative positions and being selectively operable independently of each other, said detent activating mechanism, when in said first operative position thereof, including means forcibly locating a detent of said detent activating mechanism in said detent-receiving means to prevent removal of said expander rod from said detent activating mechanism while simultaneously maintaining the coaxial relationship between said opening and said expander rod, said second operative position facilitating a withdrawal of said detent out of said detent-receiving means thereby facilitating removal of said expander rod from said detent activating mechanism.

2. The mechanical tube expander according to claim 1, wherein said first means includes a first slide plate guided for reciprocating movement in a direction perpendicular to said axes of said expander rods and between first and second positions, said first slide plate having through openings corresponding in number, spacing and arrangement to the number, spacing and arrangement of said expander rods, each expander rod extending through a respective opening in said first slide plate and including a reduced diameter section adapted to receive therein a first edge of one of said openings in said first slide plate such that said selected ones of said expander rods whose reduced diameter sections are aligned with said first slide plate receive said first edge therein when said first slide plate is in said first position thereof to thereby lock said selected expander rods to said pressure plate.

3. The mechanical tube expander according to claim 2, wherein said first slide plate in said second position thereof orients said openings therein coaxial with said axes of said expander rods to thereby unlock said expander rod from said pressure plate.

4. The mechanical tube expander according to claim 2, wherein when said stored expander rod locking plate is in said first position, said reduced diameter section of all expander rods are aligned with each other and oriented in a respective opening in said first slide plate.

5. The mechanical tube expander according to claim 4, wherein when said stored expander rod locking plate is in said second position with said remaining ones of said expander rods connected thereto by said second means, said reduced diameter sections of said remaining ones of said expander rods are moved to a position out of alignment with said reduced diameter sections of said selected ones of said expander rods.

6. The mechanical tube expander according to claim 1, wherein an expander plate is provided on said frame and includes third means for releasably locking said expander plate to said stored expander rod locking plate when said stored expander rod locking plate is in said second position thereof spaced from said pressure plate.

7. The mechanical tube expander according to claim 6, wherein said third means includes a plurality of spaced rods fixed to and depending from said stored expander rod locking plate, said expander plate having a plurality of holes therethrough corresponding in number, spacing and arrangement to the number, spacing and arrangement of said spacer rods, each said spacer rod being received in a respective one of said holes and includes a first reduced diameter section thereon adjacent said expander plate, and a first slide plate slidably supported on said expander plate and having through openings corresponding in number, spacing and arrangement to the number, spacing and arrangement of said holes and said spacer rods, said reduced diameter section on each said spacer rod being adapted to receive therein a first edge of one of said openings in said first slide plate such that each said spacer rod, upon receipt of said first edge of one of said openings in said reduced diameter section, thereby becomes locked to said expander plate.

8. The mechanical tube expander according to claim 6, wherein said expander plate further includes a plurality of through openings corresponding in number, spacing and arrangement to the number, spacing and arrangement of said expander rods, each of said expander rods extending through a respective said opening in said expander plate, and elongate and hollow expander tool received in each opening in said expander plate and encircling, sleeve-like, said expander rod therein, each said expander tool being locatable in said opening in a selected one of first and second positions thereof, each said expander tool having a first reduced diameter section thereon, said expander plate having a first slide plate slidably supported thereon and having through openings corresponding in number, spacing and arrangement to the number, spacing and arrangement of said expander tools, said first reduced diameter section on each said expander tool being adapted to receive therein a first edge of one of said openings in said first slide plate such that said expander tools whose first reduced diameter sections are aligned with said first slide plate receive said first edge therein to thereby lock said expander tools to said expander plate in said first position thereof.

9. The mechanical tube expander according to claim 8, wherein each said expander tool includes a second reduced diameter section thereon spaced from said first reduced diameter section thereon;

wherein selected ones of said expander tools are deployed in said first position thereof so as to engage said tubes of said assembly, remaining ones of said expander tools being retracted away from said tubes of said assembly when said remaining expander tools are in said second position thereof, whereat said second reduced diameter sections thereof are aligned with said first edge of respective openings in which they reside to receive therein said first edge such that said selected ones of said expander tools are in said first position thereof on said expander plate whereas said remaining ones of said expander tools are in said second positions thereof on said expander plate.

10. The mechanical tube expander according to claim 1, wherein said means for reciprocating said stored expander rod locking plate includes a piston and cylinder actuator, said cylinder being mounted on at least one of said pressure plate and said stored expander rod locking plate and oriented such that a piston rod thereof rests on the other of said stored expander rod locking plate and said pressure plate, an extension and retraction of said piston rod relative to said cylinder effecting movement of said stored expander rod locking plate between said first and second positions thereof.

11. The mechanical tube expander according to claim 1, wherein each said expander rod has slidably mounted thereon an expander tool, said tube expanding means preventing said expander tool from sliding off the end of said expander rod having said tube expanding means thereat.

12. The mechanical tube expander according to claim 1, wherein means are provided for preventing a rotation of each said expander rod about its axis.

13. The mechanical tube expander according to claim 12, wherein said means for preventing a rotation of each said expander rod includes at least one pin extending radially outwardly on each said expander rod and an elongate recess extending on a radius from each said opening and receiving therein said pin.

14. The mechanical tube expander according to claim 13, wherein each expander rod has a pair of axially spaced apart pins and said openings on said pressure plate and said stored expander rod locking plate each have said elongate recess extending on a radius and configured to receive a respective said pin therein.

15. In a mechanical tube expander for expanding tubes into interlocked relationship with fins, comprising:

a frame;

means for holding on said frame an assembly of fins loosely stacked on tubes;

a pressure plate carrying a plurality of expander rods with parallel axes and which are aligned with the tubes, said expander rods having tube-expanding means at one end thereof and detent receiving means close to the opposite end thereof; and means for reciprocating said expander rods with respect to said assembly in order to expand the tubes into interlocked relationship with the fins that are stacked thereon, the improvement comprising:

a stored expander rod locking plate;

means for reciprocating said stored expander rod locking plate between first and second positions with respect to said pressure plate when said pressure plate is retracted from said assembly;

first means for releasably locking selected ones of said expander rods to said pressure plate;

second means for releasably locking the remaining ones of said expander rods separate from said selected ones to said stored expander rod locking plate and only when said stored expander rod locking plate is in said first position thereof positioned adjacent said pressure plate, said remaining ones of said expander rods being moved with said stored expander rod locking plate in response to a movement thereof from said first position to said second position thereof to thereby cause said remaining expander rods to remain free of a locked connection to said pressure plate so that only said selected ones of said expander rods are reciprocated with respect to said assembly; and an expander plate on said frame and third means for releasably locking said expander plate to said stored expander rod locking plate when said stored expander rod locking plate is in said second position thereof spaced from said pressure plate.

16. The mechanical tube expander according to claim 15, wherein said third means includes a plurality of spaced rods fixed to and depending from said stored expander rod locking plate, said expander plate having a plurality of holes therethrough corresponding in number, spacing and arrangement to the number, spacing and arrangement of said spacer rods, each said spacer rod being received in a respective one of said holes and includes a reduced diameter section thereon adjacent said expander plate, and a first slide plate slidably supported on said expander plate and having through openings corresponding in number, spacing and arrangement to the number, spacing and arrangement of said holes and said spacer rods, said reduced diameter section on each said spacer rod being adapted to receive therein an edge of one of said openings in said first slide plate such that each said spacer rod, upon receipt of said edge of one of said openings in said reduced diameter section, thereby becomes locked to said expander plate.

17. The mechanical tube expander according to claim 15, wherein said expander plate further includes a plurality of through openings corresponding in number, spacing and arrangement to the number, spacing and arrangement of said expander rods, each of said expander rods extending through a respective said opening in said expander plate, an elongate and hollow expander tool received in each opening in said expander plate and encircling, sleeve-like, said expander rod therein, each said expander tool being locatable in said opening in a selected one of first and second positions thereof, each said expander tool having a first reduced diameter section thereon, said expander plate having a second slide plate slidably supported thereon and having through openings corresponding in number, spacing and arrangement to the number, spacing and arrangement of said expander tools, said first reduced diameter section on each said expander tool being adapted to receive therein a second edge of one of said openings in said second slide plate such that said expander tools whose first reduced diameter sections are aligned with said second slide plate receive said second edge therein to thereby lock said expander tools to said expander plate in said first position thereof.

18. The mechanical tube expander according to claim 17, wherein each said expander tool includes a second reduced diameter section thereon spaced from said first reduced diameter section thereon;

wherein selected ones of said expander tools are deployed in said first position thereof so as to engage said tubes of said assembly, remaining ones of said expander tools being retracted away from said tubes of said assembly when said remaining expander tools are in said second position thereof, whereat said second reduced diameter sections thereof are aligned with said second edge of respective openings in which they reside to receive therein said second edge such that said selected ones of said expander tools are in said first position thereof on said expander plate whereas said remaining ones of said expander tools are in said second positions thereof on said expander plate.

19. In a mechanical tube expander for expanding tubes into interlocked relationship with fins, comprising:

a frame;

means for holding on said frame an assembly of fins loosely stacked on tubes;

a pressure plate carrying a plurality of expander rods with parallel axes and which are aligned with the tubes, said expander rods having tube-expanding means at one end thereof and detent receiving means close to the opposite end thereof; and means for reciprocating said expander rods with respect to said assembly in order to expand the tubes into interlocked relationship with the fins that are stacked thereon, the improvement comprising:

a stored expander rod locking plate;

means for reciprocating said stored expander rod locking plate between first and second positions with respect to said pressure plate when said pressure plate is retracted from said assembly;

first means for releasably locking selected ones of said expander rods to said pressure plate;

second means for releasably locking the remaining ones of said expander rods separate from said selected ones to said stored expander rod locking plate and only when said stored expander rod locking plate is in said first position thereof positioned adjacent said pressure plate, said remaining ones of said expander rods being moved with said stored expander rod locking plate in response to a movement thereof from said first position to said second position thereof to thereby cause said remaining expander rods to remain free of a locked connection to said pressure plate so that only said selected ones of said expander rods are reciprocated with respect to said assembly; and an expander plate on said frame and third means for releasably locking said expander plate to said stored expander rod locking plate when said stored expander rod locking plate is in said second position thereof spaced from said pressure plate, expander plate further including a plurality of through openings corresponding in number, spacing and arrangement to the number, spacing and arrangement of said expander rods, each of said expander rods extending through a respective said opening in said expander plate, an elongate and hollow expander tool received in each opening in said expander plate and encircling, sleeve-like, said expander rod therein, each said expander tool being locatable in said opening in a selected one of first and second positions thereof; and a guide plate affixed to a plurality of spaced rods fixed to and depending from said stored expander rod locking plate, said guide plate being oriented above said expander tools and configured to engage said expander tools oriented in said second position and urging them to said first position in response to a movement of said stored expander rod locking plate toward said first position thereof so as to deploy said expander tools for working engagement with the tubes.

20. The mechanical tube expander according to claim 19, wherein said third means includes a plurality of spaced rods fixed to and depending from said stored expander rod locking plate, said expander plate having a plurality of holes therethrough corresponding in number, spacing and arrangement to the number, spacing and arrangement of said spacer rods, each said spacer rod being received in a respective one of said holes and includes a first reduced diameter section thereon adjacent said expander plate, and a first slide plate slidably supported on said expander plate and having through openings corresponding in number, spacing and arrangement to the number, spacing and arrangement of said holes and said spacer rods, said first reduced diameter section on each said spacer rod being adapted to receive therein a first edge of one of said openings in said first slide plate such that each said spacer rod, upon receipt of said first edge of one of said openings in said reduced diameter section, thereby becomes locked to said expander plate.

21. The mechanical tube expander according to claim 19, wherein said expander tool has a second reduced diameter section thereon, said expander plate having a second slide plate slidably supported thereon and having through openings corresponding in number, spacing and arrangement to the number, spacing and arrangement of said expander tools, said second reduced diameter section on each said expander tool being adapted to receive therein a second edge of one of said openings in said second slide plate such that said expander tools whose second reduced diameter sections are aligned with said second slide plate receive said second edge therein to thereby lock said expander tools to said expander plate in said first position thereof.

22. The mechanical tube expander according to claim 21, wherein each said expander tool includes a third reduced diameter section thereon spaced from said second reduced diameter section thereon;

wherein selected ones of said expander tools are deployed in said first position thereof so as to engage said tubes of said assembly, remaining ones of said expander tools being retracted away from said tubes of said assembly when said remaining expander tools are in said second position thereof, whereat said third reduced diameter sections thereof are aligned with said second edge of respective openings in which they reside to receive therein said second edge such that said selected ones of said expander tools are in said first position thereof on said expander plate whereas said remaining ones of said expander tools are in said second positions thereof on said expander plate.

* * * * *